US005660739A

United States Patent [19]

Ozaki et al.

[11] Patent Number: 5,660,739

[45] Date of Patent: Aug. 26, 1997

[54] METHOD OF PRODUCING SUBSTRATE FOR INK JET RECORDING HEAD, INK JET RECORDING HEAD AND INK JET RECORDING APPARATUS

[75] Inventors: Teruo Ozaki; Masami Ikeda, both of Yokohama; Masami Kasamoto, Ayase; Toshihiro Mori, Yokohama; Masahiko Tonogaki, Tokyo; Yuji Kamiyama, Fujisawa, all of Japan

[73] Assignee: Canon Kabushiki Kaisha, Tokyo, Japan

[21] Appl. No.: 517,692

[22] Filed: Aug. 22, 1995

[30] Foreign Application Priority Data

Aug. 26, 1994 [JP] Japan ..... 6-201644

[51] Int. Cl.[6] ..... B41J 2/05

[52] U.S. Cl. ..... 216/27; 347/62; 347/64

[58] Field of Search ..... 216/27

[56] References Cited

U.S. PATENT DOCUMENTS

| | | | |
|---|---|---|---|
| 4,451,994 | 6/1984 | Takahashi et al. | 347/64 |
| 4,536,250 | 8/1985 | Ikeda et al. | 156/651 |
| 4,567,493 | 1/1986 | Ikeda et al. | 346/140 R |
| 4,602,261 | 7/1986 | Matsuda et al. | 346/140 R |
| 4,631,555 | 12/1986 | Ikeda et al. | 346/140 R |
| 4,694,306 | 9/1987 | Ikeda et al. | 346/140 R |
| 4,719,478 | 1/1988 | Tachihara et al. | 346/140 R |
| 4,720,716 | 1/1988 | Ikeda et al. | 346/140 R |
| 4,723,129 | 2/1988 | Endo et al. | 346/1.1 |
| 4,725,859 | 2/1988 | Shibata et al. | 346/140 R |
| 4,740,796 | 4/1988 | Endo et al. | 346/1.1 |
| 5,140,345 | 8/1992 | Komuro | 346/140 R |
| 5,182,577 | 1/1993 | Ishinaga et al. | 346/140 R |
| 5,187,499 | 2/1993 | Murakami | 346/140 R |
| 5,374,332 | 12/1994 | Koyama et al. | 156/643 |
| 5,451,994 | 9/1995 | Takahashi et al. | 347/64 |
| 5,559,543 | 9/1996 | Komuro | 347/62 |

FOREIGN PATENT DOCUMENTS

| | | |
|---|---|---|
| 0390338 | 10/1990 | European Pat. Off. . |
| 0477378 | 4/1992 | European Pat. Off. . |
| 3443564 | 6/1985 | Germany . |
| 62-103148 | 5/1987 | Japan . |

*Primary Examiner*—R. Bruce Breneman
*Assistant Examiner*—Michael E. Adjodha
*Attorney, Agent, or Firm*—Fitzpatrick, Cella, Harper & Scinto

[57] ABSTRACT

A method for producing a substrate for an ink jet recording head comprises preparing a substrate with plural heat generating resistors for applying heat to the ink, plural wirings electrically connected thereto, and plural heat generating areas formed by the heat generating resistors exposed from the wirings, coating the heat generating resistors and the wirings on the substrate with a first insulating protective film, removing the first insulating protective film by wet etching in portions on the heat generating areas, and coating thus etched first insulating protective film with a second insulating protective film, wherein the etched portion of the first insulating protective film, in the longitudinal direction of the heat generating area, is positioned inside from the end of the heat generating area, by at least ½ of the thickness of the first and second insulating protective films covering the wirings.

The protective film is thus made thinner on the heat generating areas, thus reducing the electric power consumption while maintaining sufficient durability.

11 Claims, 5 Drawing Sheets

METHOD OF PRODUCING SUBSTRATE FOR INK JET RECORDING HEAD, INK JET RECORDING HEAD AND INK JET RECORDING APPARATUS

BACKGROUND OF THE INVENTION

1. Field of the Invention

The present invention relates to an ink jet recording head, and more particularly to a method for producing a heat-generating substrate for an ink jet recording head adapted for effecting recording by ink discharge from a discharge opening by growth and contraction of a bubble generated in the ink by a discharge energy generating element, such recording head and a recording apparatus utilizing such recording head.

2. Related Background Art

The ink jet recording method described in the U.S. Pat. No. 4,723,129 or No. 4,740,796 is recently attracting particular attention as it is capable of image recording with a high definition and high image quality at a high speed and a high density, and is also suitable for color image recording and for compactization of the apparatus. In a representative configuration of the recording apparatus employing such method, there is provided a heat action area for applying heat to the recording liquid or the like (hereinafter called ink) in order to discharge the ink by thermal energy. More detailedly, corresponding to an ink flow path, there is provided an electro-thermal converting element including a pair of connecting electrodes and a heat-generating resistance layer connected between said electrodes and adapted to generate heat in the area between the electrodes, and the thermal energy generated from said heat-generating resistance layer is utilized for rapidly heating the ink on the heat action area to generate bubble whereby the ink is discharged by such bubble generation.

Since such heat action area of the ink jet recording head is exposed to severe conditions including mechanical impact and erosion resulting from cavitation caused by repeated bubble generation and extinction in the ink and temperature ascent and descent of about 1000° C. within an extremely short time of 0.1 to 10 microseconds, there is provided a protective film for protecting the heat-generating resistance layer from such harsh conditions. Such protective film is required to be excellent in heat resistance, liquid resistance, resistance to liquid permeation, stability against oxidation, electric insulation, breakage resistance and thermal conductivity, and is generally composed of an inorganic compound such as SiO or SiN. Also a single-layered protective film may not be sufficient for protecting the heat-generating resistance layer, and a metallic film of higher anticavitation property, composed for example of Ta, may be provided on the protective film.

The above-explained configuration is employed not only on the heat-generating resistance layer but also on the wiring patterns for electric connection with the heat-generating resistance layer, in order to prevent corrosion of the wirings by the ink.

FIG. 3 is a schematic plan view of a part of the substrate for a conventional ink jet recording head, and FIG. 4 is a partial cross-sectional view of said substrate along a chain line 4—4, in FIG. 3.

Referring to FIGS. 3 and 4, a Si substrate 120 is provided thereon with a heat accumulating layer 106 composed of $SiO_2$, formed for example by thermal oxidation. On said substrate 120 with the heat accumulating layer 106, there are formed a heat-generating resistance layer 107 for applying thermal energy to the ink, and wirings 103, 104 for applying a voltage to said heat-generating resistance layer. A part of the heat-generating resistance layer 107, exposed from the wirings 103, 104 constitutes a heat-generating portion 102. On said heat-generating resistance layer and wirings, there are provided an insulating protective film 108 and an anti-cavltation Ta film 110.

In the ink jet recording head, the heat-generating substrate constituting the heat action area is constructed as explained above, and the structure of the protective film mentioned above is an important factor determining the performance of the ink jet recording head, such as the electric power consumption and the service life thereof.

However, in the conventional configuration of the protective film, the reduction in electric power consumption is a trade-off to the improvement in film reliability and service life.

For example, the electric power required for bubble generation can be reduced as the film between the heat-generating resistance and the ink becomes thinner or has a higher thermal conductivity, since heat dissipation other than to the ink can be reduced. Stated differently, the efficiency of energy can be improved as the protective film becomes thinner.

On the other hand, a thinner protective film is apt to form pinholes thereon or to be unable to sufficiently cover the stepped portion of the wiring, resulting in defective coverage on such stepped portion. Such defective coverage results in ink intrusion, thus leading to erosion of the wiring and the heat-generating resistance and deterioration in the reliability and in the service life.

In consideration of the foregoing, the Japanese Patent Laid-open Application No. 62-103148 discloses a configuration of forming the protective film thinner only in a portion thereof involved in the bubble generation, thereby reducing the electric power consumption while improving the film reliability and the service life.

However, in the above-mentioned patent, dry half etching is suggested for forming the thinner portion of the protective film, but the film thickness is difficult to control with such method because the film thickness is principally controlled by the etching time in this method.

On the other hand, on the heat-generating portion in the ink jet recording head, the protective film is required to have a uniform thickness, since, if the protective film on the heat-generating portion is uneven in thickness, the center of bubble generation may be displaced from the center of the heat-generating resistor or the bubble generating characteristics may be altered to affect the ink discharge characteristics.

As explained in the foregoing, the conventional configuration is apt to cause fluctuation in the thickness of the protective film on the heat generating portion in the recording head, so that uniform discharge characteristics are difficult to obtain among different discharge openings and there may result deterioration in the print quality.

SUMMARY OF THE INVENTION

The present invention has been attained in consideration of the prior art explained above, and an object thereof is to provide an ink jet recording head which enables easy control of the film thickness, thereby providing stable ink discharge performance. Another object of the present invention is to provide an ink jet recording head capable of reducing the electric power consumption for bubble generation, while improving the reliability and extending the service life.

The above-mentioned objects can be attained, according to the present invention, by a method for producing a substrate for an ink jet recording head provided with at least two insulating protective films, comprising a step of preparing a substrate having thereon plural heat-generating resistors for applying heat to the ink, plural wiring electrically connected to said heat-generating resistors, and plural heat-generating portions composed of said heat-generating resistors exposed from said wirings; a step of coating said heat-generating resistors and said wirings on said substrate with a first insulating protective film; a step of eliminating said first insulating protective film with wet etching in areas on said heat-generating portions; and a step of applying a second insulating protective film on said first insulating protective film subjected to said etching, wherein the etched portion of said first insulating protective film in the longitudinal direction of said heat generating portion is provided inside the ends of the heat generating portion, by at least ½ of the thickness of said first and second insulating protective films covering said wiring. According to the present invention, the thickness of the thinner portion of the protective films can be securely controlled as the heat-generating resistor can be utilized as the etching stopper, so that there can be obtained an ink jet recording head with uniform ink discharge characteristics. Also there can be obtained an ink jet recording head with a reduced electric power consumption for bubble generation, with improved reliability and elongated service life.

DESCRIPTION OF THE PREFERRED EMBODIMENTS

Now the present invention will be clarified in detail in the following description.

The present invention achieves different film thicknesses without half etching by employing a two-layered structure in the insulating protective film, thereby enabling secure film thickness control in the thinner portion of the film and eliminating the fluctuation in the thickness of the protective film on the heat-generating area. Also the insulating protective film of the present invention is free from, in the multi-layered structure thereof, interfacial peeling as sometimes encountered in the conventional configuration consisting of an inorganic film and an organic film, whereby the reduction in the electric power consumption can be securely achieved without deterioration in the reliability of the recording head.

The first insulating protective film is-composed of a material with a high wet etching rate selected among the material ordinarily employed in the semiconductor process, and preferred examples of such material include PSG and SiO.

Also the second insulating protective film is composed of a material showing few pinholes even at a small thickness and being excellent in insulating property, thermal conductivity and ink resistance, and preferred examples of such material include SiN and SiO.

The thickness has to be about 1 μm as in the conventional structure at least on the electrodes, but, in the heat-generating areas, can be at least 2000 Å, preferably at least 3000 Å for securing the durability as in the conventional configuration. This is because TaN constituting the heat-generating resistance layer has a smoother surface in comparison with the Al electrode, so that pinhole formation can be suppressed even with a smaller film thickness. On the other hand, the effect of electric power reduction can no longer be observed if the film thickness on the heat generating area exceeds about 7000 Å. Consequently the thickness of the film in the thinner portion thereof is preferably selected within a range from 2000 to 7000 Å.

In the following there will be explained embodiments of the present invention with reference to the attached drawings, but the present invention is not limited by such embodiments and can assume any form that can attain the objects of the present invention.

Embodiment 1

Figure 1:
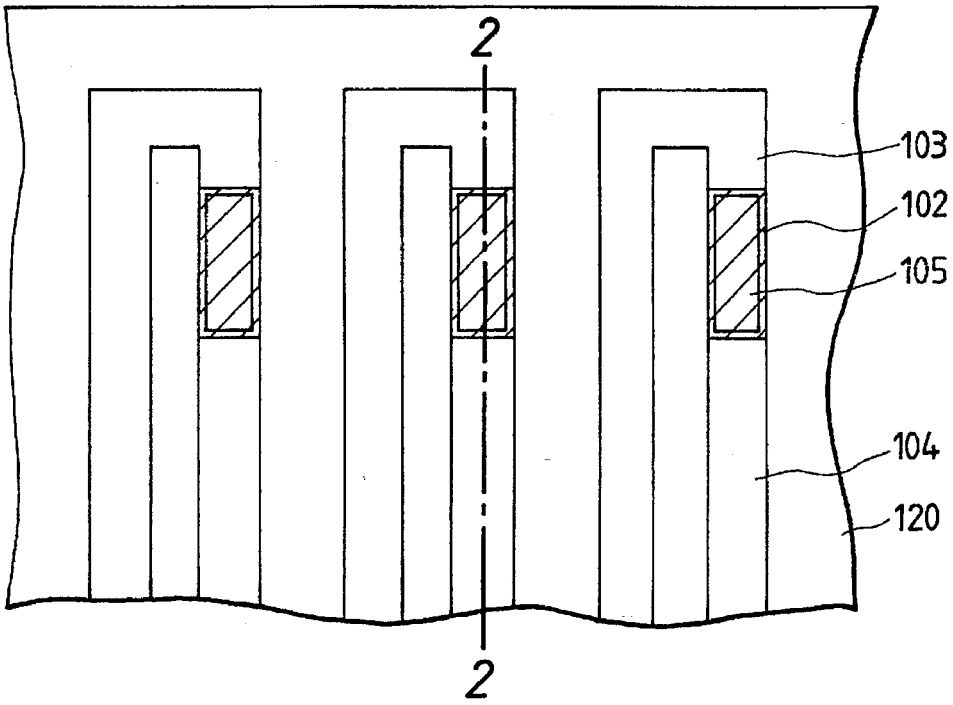
FIG. 1 is a plan view of a heat-generating substrate for an ink jet recording head constituting a first embodiment of the present invention.
Figure 2:
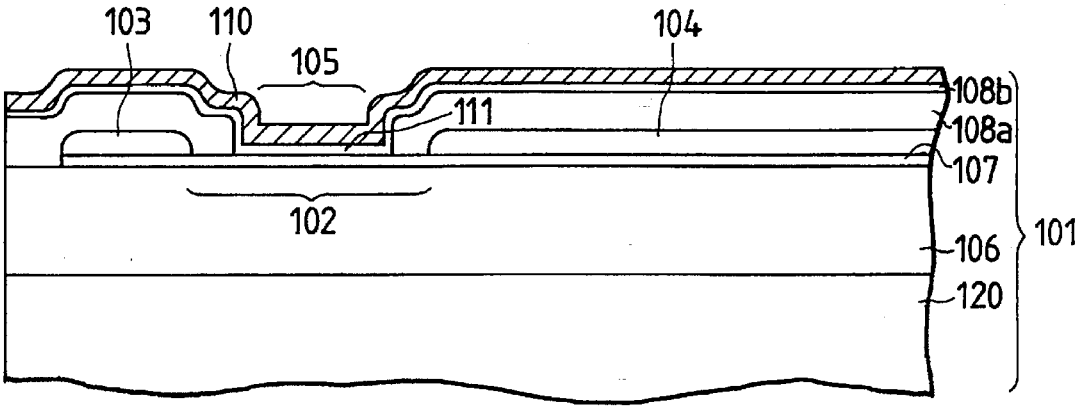
FIG. 2 is a cross-sectional view of the heat-generating substrate along a chain line 2—2 in FIG. 1.
Figure 3:
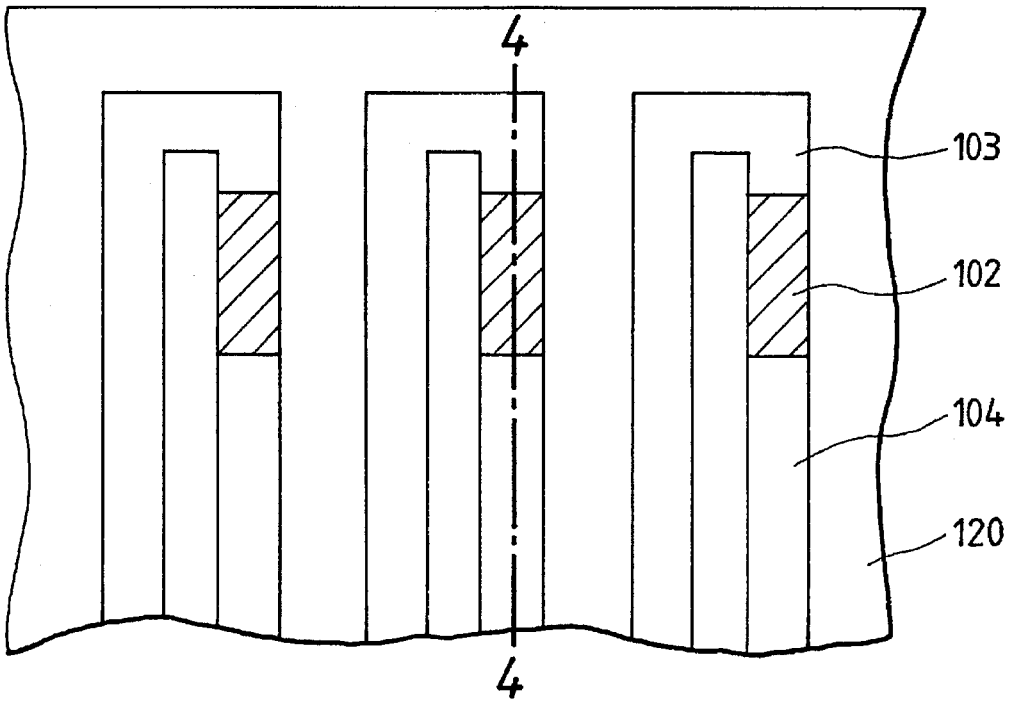
FIG. 3 is a plan view of a heat-generating substrate of a conventional ink jet recording head.
Figure 4:
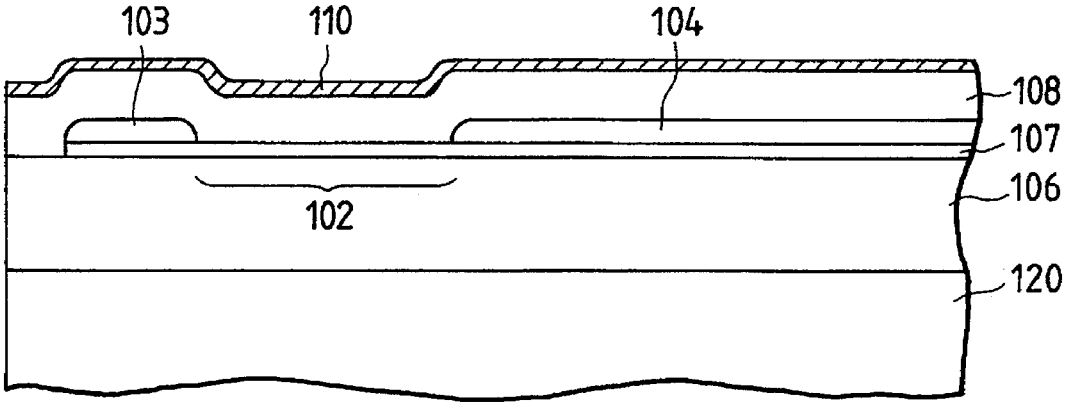
FIG. 4 is a cross-sectional view of the heat-generating substrate along a chain line 4—4 in FIG. 3.

FIG. 1 is a plan view of a heat generating substrate, for generating bubbles in the ink, in an ink jet recording head, constituting an embodiment of the present invention, and FIG. 2 is a partial vertical cross-sectional view along a chain line 2—2 in FIG. 1.

The heat-generating substrate of the present embodiment is prepared from Si substrate 120 or a Si substrate on which driving IC's are already formed. In case of the Si substrate, a heat accumulating $SiO_2$ layer is formed by thermal oxidation, sputtering or CVD, under the heat-generating resistors. Also in case of the Si substrate bearing the driving IC's, a heat accumulating $SiO_2$ layer is formed with a thickness of 2.9 μm in the manufacturing process. Said layer is indicated by 106 in FIG. 1.

Then a TaN layer 107 serving as the heat generating resistor is formed by reactive sputtering with a thickness of ca. 1000 Å, and Al layers 103, 104 serving as the wirings are formed by sputtering with a thickness of 6000 Å.

Subsequently wiring patterns shown in FIG. 1 are formed by a photolithographic process, and Al and TaN are etched consecutively by reactive etching.

Then the photolithographic process is used again and Al is removed by wet etching, in order to expose the heat generating portion as indicated by 102 in FIGS. 1 and 2. Such removed portion constitutes the heat generating resistor. Ends of the wiring patterns are formed as bonding pads in case of the Si substrate, but are connected to the lower electrodes through contact holes in case of the substrate bearing IC's thereon.

Then, on the Si substrate, a PSG layer serving as the first insulating protective film is formed by plasma CVD with a thickness of 7000 Å. Subsequently a window pattern is formed, by a photolithographic process, inside the heat Generating area 105 shown in FIGS. 1 and 2 by at least 0.5 μm as represented by 108*a* shown in FIG. 2 so as to avoid the influence of step difference in the electrodes, and wet etching is conducted with buffered fluoric acid for 1 to 5 minutes until the PSG layer is etched off. The buffered fluoric acid has an etching rate of 2000–10000 Å/min. for the PSG layer. As long as the range of the window formed by the photolithographic process is on the heat generating resistor, the wet etching does not require particular control in time because the heat generating resistor consisting of TaN serves as an etching stopper, but, in consideration of the step coverage, the distance from the end of the electrode to the window in the longitudinal direction thereof is preferably at least ½ of the thickness of the protective film provided thereon. In the present embodiment, the window is positioned at a distance of 0.5 μm from the end face of the Al electrode as explained before. Then an SiN layer 108*b* constituting the second insulating protective film is formed by plasma CVD with a thickness of 3000 Å, so as to cover thus pattern PSG layer. Since the PSG layer and the SiN layer are both formed at 300° C. or higher, both layers show extremely strong mutual adhesion, thus scarcely resulting in interfacial peeling which is sometimes encountered in the conventional two-layered structure consisting of an inorganic film and an organic film. In this manner there can be formed an insulating protective film having a thickness of 3000 Å in the heat generating areas and a thickness of 10000 Å in other parts.

Then, on said inorganic insulating film, Ta is deposited by sputtering as an anticavttation and ink resistant film 110 shown in FIG. 2, with a thickness of ca. 2500 Å. Finally Ta, PSG and SiN are photolithographically removed by reactive etching to form wire bonding pads, whereby a heat-generating substrate 101 in FIG. 2, for bubble formation in the ink, for use in the ink jet recording head, is completed. Said substrate in the ink jet recording head, is completed. Said substrate is used in the known manner for preparing an ink jet recording head.

The ink jet recording head thus prepared was subjected to ink discharge with a frequency of 3 kHz, with a voltage of ca. 23 V and a pulse duration of 7 μs corresponding to 1.3 times of the bubble forming energy. The breakage by the destruction of the heat generating resistors was not observed until $3\times10^8$ pulses, so that the durability was comparable to that of the ordinary protective film with a thickness of 1 μm. Also the electric power consumption required for bubble formation was about 30% less in case of the protective film of 3000 Å on the heat generating resistors, in comparison with the ordinary protective film of 1 μm.

Embodiment 2

In the Embodiment 1, the window pattern of the first insulating protective film is formed inside the heat generating resistor, so that the exposed width thereof is determined by said window pattern. However, particularly in case the heat generating resistors are arranged with a high density, it may become impossible to secure enough accuracy for the window pattening, so that the widths of the heat generating resistors become uneven. Such uneven widths of the heat generating resistors lead to uneven discharge characteristics at the ink discharge openings, thereby deteriorating the print quality. In consideration of such drawback, the window pattern in the first insulating protective film in this embodiment is made larger than the heat generating resistor in the direction of array thereof, whereby the width of the heat generating area is always defined by the width of the heat generating resistor. Consequently there can be obtained an ink jet recording head with uniform ink discharge characteristics even in case the heat generating resistors are arranged with a high density.

In the following there will be explained the method of producing the insulating protective films of the present embodiment. Other parts can be same as those in the Embodiment 1.

Figure 5:
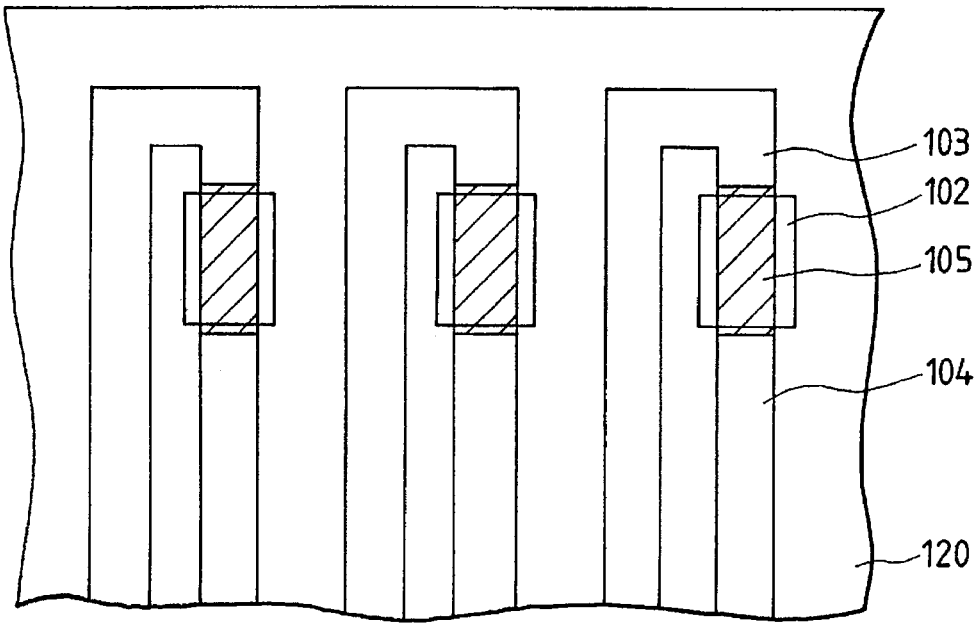
FIG. 5 is a plan view of a heat-generating substrate of an ink jet recording head constituting a second embodiment of the present invention.
Figure 6:
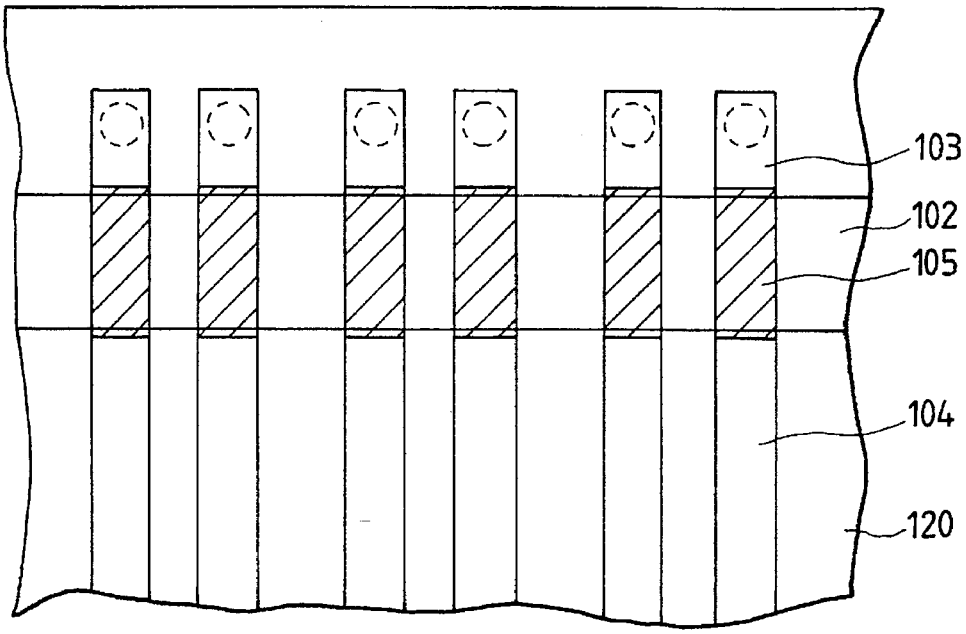
FIG. 6 is a plan view of a heat-generating substrate of an ink jet recording head constituting a variation of the second embodiment of the present invention.

After a heat accumulating layer, heat generating resistors and electrodes are prepared on a Si substrate as in the Embodiment 1, a PSG layer as the first insulating protective film is formed on said substrate by plasma CVD with a thickness of 7000 Å. Then window are photolithographically formed on said first insulating protective film. In the present embodiment, the window pattern is formed, as shown in FIG. 5, inside by 0.5 μm from the end face of the electrodes in the longitudinal direction and outside by 4 μm at each side of the heat generating resistor in the direction of array thereof. Such window pattern, made larger than the width of the heat generating resistor in the direction of array thereof, allows to obtain uniform widths of the heat generating areas, but such window pattern results in etching of a part of the heat accumulating layer. Consequently the etching ratio of the heat accumulating layer and the first insulating protective layer is selected as 1:4, so that the etch depth of the heat accumulating layer, even if it is etched, remains at 500 to 1500 Å and the step coverage of the protective films in this area is not significantly deteriorated. The window patterning is achieved by wet etching with buffered fluoric acid for 1 to 5 minutes until the PSG layer is etched off, and the buffered fluoric acid is so selected to have etching rates of 2000 to 10000 Å/min. for the PSG layer and 500 to 2500 Å/min. for the heat accumulating $SiO_2$ layer.

Subsequently an SiN layer, constituting the second insulating protective film, is formed by plasma CVD with a thickness of 3000 Å, so as to cover thus patterned PSG layer. Since the PSG layer and the SiN layer are both formed at a high temperature exceeding 300° C., these two layers show extremely strong mutual adhesion and are substantially free from interfacial peeling, which is sometimes encountered in the two-layered structure consisting of an inorganic film and an organic film. In this manner there is obtained an inorganic insulating film having thicknesses of 3000 Å in the heat generating areas and 10000 Å in other parts.

An ink jet recording head, utilizing thus obtained substrate of the present embodiment, did not show breakage by the destruction of the heat generating resistors up to $3\times10^8$ pulses in an ink discharge durability test under same conditions as those in the Embodiment 1. Also the electric power consumption required for bubble generation was reduced by 30% in case the protective film of 3000 Å was formed on the heat generating area, in comparison with the case with the ordinary protective film of 1 μm.

In the foregoing description, each heat generating area has an independent etched area in the first insulating protective film, but, in case the heat generating areas are arranged with a high density and a common wiring is formed in a lower layer, the etched portion of the heat generating area may be connected to that of another heat generating area adjacent in the direction of array of the heat generating areas, and the effect of the present invention can still be attained.

In the following there will be explained the ink jet recording head and the ink jet recording apparatus in which the substrate of the present invention is applicable.

Figure 7:
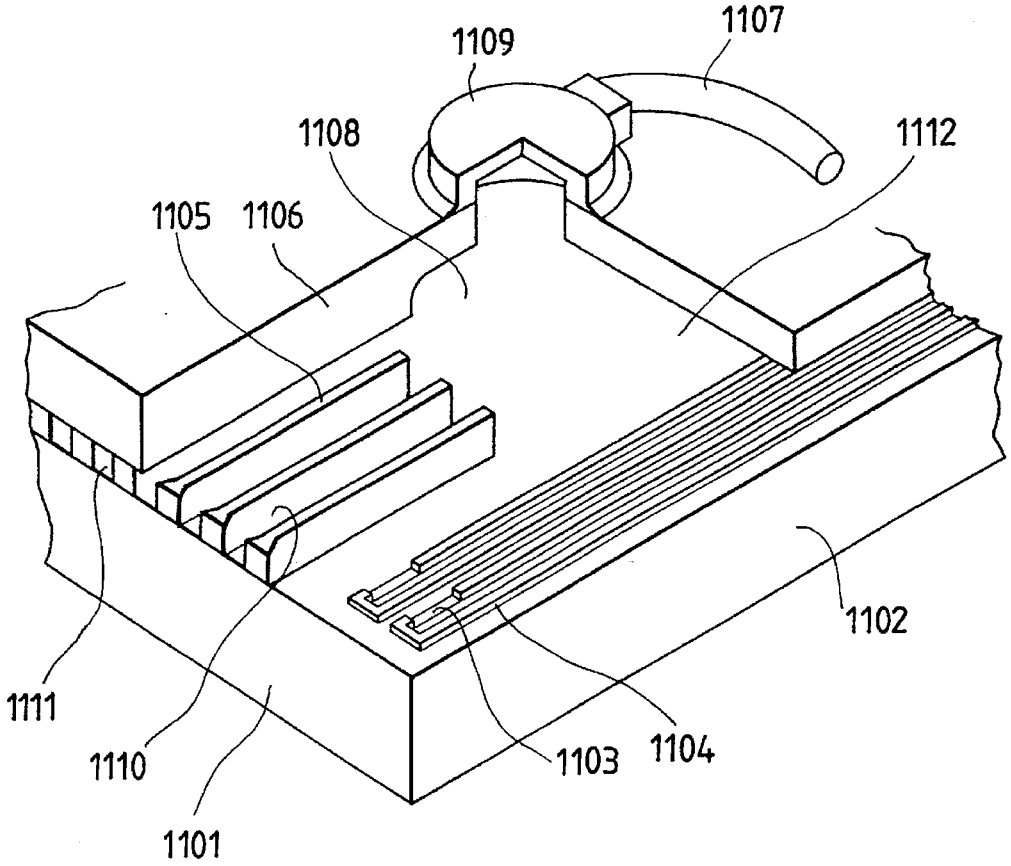
FIG. 7 is a schematic view of an ink jet recording head in which the substrate of the present invention is applicable.

FIG. 7 is a schematic view of such ink jet recording head, composed of electrothermal converters 1103, wirings 1104 and liquid path walls 1105 formed on a substrate 1102 through semiconductor process steps such as etching, evaporation and sputtering, and a top plate 1106.

Recording liquid 1112 is supplied, from an unrepresented liquid reservoir, through a liquid supply pipe 1107 to a common liquid chamber 1108 of the recording head 1101.

1109 indicates a liquid supply pipe connector. The liquid 1112 supplied into the common liquid chamber 1108 is further supplied to the liquid paths 1110 by capillary action, and is stably maintained, by meniscus formation, at the surface of discharge openings (orifice surface) at the ends of the liquid paths.

The energization of the electrothermal converter 1103 causes rapid heating of the liquid present on the face of said electrothermal converter, thereby generating a bubble in the liquid path, and the liquid is discharged from the discharge opening 1111 by the expansion and construction of said bubble to form a liquid droplet.

Figure 8:
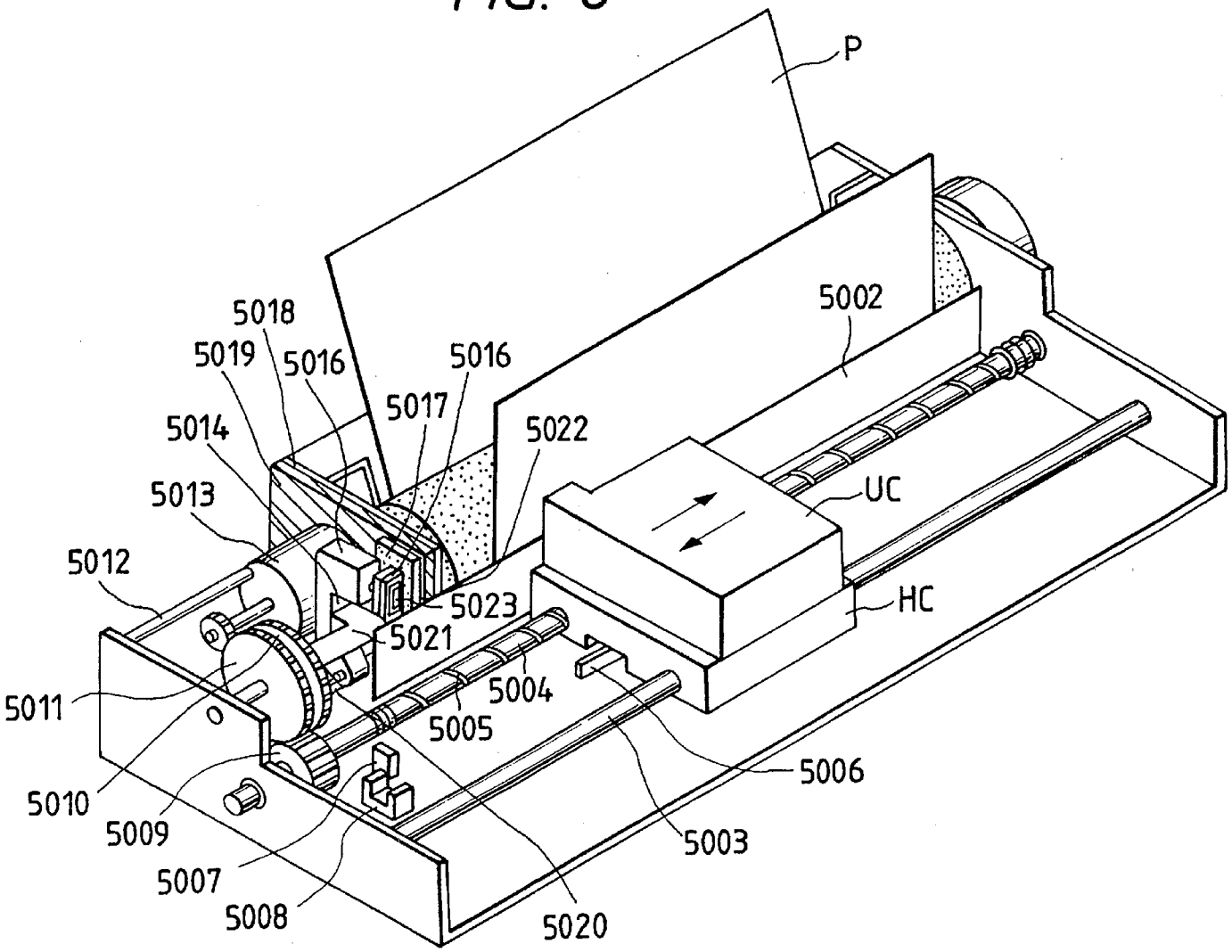
FIG. 8 is a schematic perspective view of an ink jet recording apparatus employing an ink let recording head in which the substrate of the present invention is applicable.

FIG. 8 is a schematic perspective view of an ink jet recording apparatus in which the present invention is applicable, wherein a carriage HC engaging with a spiral groove 5005 of a lead screw 5004, rotated according to the forward or reverse rotation of a driving motor 5013 through transmission gears 5011, 5009, is provided with a pin (not shown) and is reciprocated as indicated by arrows. A paper support plate 5002 is provided to press a recording sheet toward a platen 5000 over the moving direction of the carriage. Photocouplers 5007, 5008 constitute home position detecting means, for detecting the presence of a carriage lever 5006 in the position of said photocouplers and switching the rotating direction of the motor 5013. A support member 5016 is provided for supporting a cap member 5022 for capping the front face of the recording head, and suction means 5015 sucks the interior of said cap member, thereby effecting suction recovery of the recording head through a cap aperture 5023. A cleaning blade 5017 and a member 5019 for advancing or retracting said blade are supported by a support plate 5018 of the main body. The cleaning blade is not limited to the illustrated form but can assume any known form. A lever 5012 for initiating the suction of the suction recovery operation is moved by a cam 5020 engaging with the carriage, and is controlled by the driving force of the driving motor through known transmeans such as a clutch.

These operations of capping, cleaning and suction recovery are conducted at respective positions by the function of the lead screw 5004 when the carriage is brought to the area at the home position side, and they are all applicable to the present embodiment if each desired operation is conducted at the known timing. Configurations explained above are excellent singly or in combination and constitute preferred embodiments for the present invention. The above-explained apparatus is further provided with drive signal supply means for driving the elements for generating the ink discharge pressure.

What is claimed is:

1. A method for producing a substrate for an ink jet recording head, comprising steps of:

preparing a substrate provided with plural heat generating resistors for applying heat to the ink, plural wirings electrically connected to said heat generating resistors, and plural heat generating areas formed by said heat generating resistors exposed from said wirings;

coating said heat generating resistors and said wirings on said substrate with a first insulating protective film;

removing said first insulating protective film by wet etching in portions on said heat generating areas; and coating thus etched first insulating protective film with a second insulating protective film;

wherein the etched portion of said first insulating protective film in the longitudinal direction of said heat generating area, is positioned inside from the end of the heat generating area, by at least ½ of the thickness of said first and second insulating protective films covering said wirings.

2. A method according to claim 1, further comprising a step of forming an anticavttation film on said second insulating protective film.

3. A method according to claim 2, wherein said anticavitation film is composed of Ta.

4. A method according to claim 1, wherein the etched portion of said first insulating protective film is extended beyond the heat generating resistor, in the direction of array of the heat generating areas.

5. A method according to claim 4, wherein said substrate is provided with a heat accumulating layer under said heat Generating areas.

6. A method according to claim 4, wherein each etched portion of said first insulating protective film is on each heat generating area is connected to the etched portions of other heat generating areas adjacent in the direction of array of the heat generating areas.

7. A method according to claim 1, where in said second insulating protective film has a thickness within a range from 2000 to 7000 Å.

8. A method according to claim 1, wherein said first insulating protective film is composed of PSG or SiO.

9. A method according to claim 1, wherein said second insulating protective film is composed on SiN or SiO.

10. A method for producing an ink jet recording head comprising steps of:

preparing a substrate provided with plural heat generating resistors for applying heat to the ink, plural wirings electrically connected to said heat generating resistors, and plural heat generating areas formed by said heat generating resistors exposed from said wirings;

coating said heat generating resistors and said wirings on said substrate with a first insulating protective film;

removing said first insulating protective film by wet etching in portions on said heat generating areas;

coating thus etched first insulating protective film with a second insulating protective film; and forming ink flow paths on said substrate, respectively corresponding to said heat generating resistors;

wherein the etched portion of said first insulating protective film, in the longitudinal direction of said heat generating area, is positioned inside from the end of the heat generating area, by at least ½ of the thickness of said first and second insulating protective films covering said wirings.

11. A method for producing an ink jet recording apparatus, comprising steps of:

preparing a substrate provided with plural heat generating resistors for applying heat to the ink, plural wirings electrically connected to said heat generating resistors, and plural heat generating areas formed by said heat generating resistors exposed from said wirings;

coating said heat generating resistors and said wirings on said substrate with a first insulating protective film;

removing said first insulating protective film by wet etching in portions on said heat generating areas;

coating thus etched first insulating protective film with a second insulating protective film; and forming ink flow paths on said substrate, respectively corresponding to said heat generating resistors;

wherein the etched portion of said first insulating protective film, in the longitudinal direction of said heat generating area, is positioned inside from the end of the heat generating area, by at least ½ of the thickness of said first and second insulating protective films covering said wirings.

* * * * *

UNITED STATES PATENT AND TRADEMARK OFFICE

CERTIFICATE OF CORRECTION

PATENT NO. : 5,660,739

DATED : August 26, 1997

INVENTOR(S) : TERUO OZAKI ET AL.

It is certified that error appears in the above-identified patent and that said Letters Patent is hereby corrected as shown below:

Title page, item [56],
REFERENCES CITED

U.S. Patent Documents
"4,451,994 6/1984 Takahashi et al. ... 347/64"
should be deleted.

COLUMN 4

Line 7, "is-composed" should read --is composed--.

COLUMN 5

Line 5, "Generating" should read --generating--.

Line 34, "anticavttation" should read --anticavitation--.

Line 62, "pattening," should read --patterning,--.

COLUMN 8

Line 22, "Generating" should read --generating--.

Line 24, "is" should be deleted.

UNITED STATES PATENT AND TRADEMARK OFFICE

CERTIFICATE OF CORRECTION

PATENT NO. : 5,660,739

DATED : August 26, 1997

INVENTOR(S) : TERUO OZAKI ET AL.

It is certified that error appears in the above-identified patent and that said Letters Patent is hereby corrected as shown below:

COLUMN 8 (CONTINUED)

Line 34, "on" should read --of--.

Signed and Sealed this

Fifteenth Day of September, 1998

Bruce Lehman

*Attest:*

BRUCE LEHMAN

*Attesting Officer*

*Commissioner of Patents and Trademarks*